United States Patent [19]

Hirose et al.

[11] Patent Number: 4,700,643

[45] Date of Patent: Oct. 20, 1987

[54] ROTARY HOOK

[75] Inventors: Tokuzo Hirose; Hiromitsu Shimizu, both of Osaka, Japan

[73] Assignee: Hirose Manufacturing Company, Ltd., Osaka, Japan

[21] Appl. No.: 743,960

[22] Filed: Jun. 12, 1985

[30] Foreign Application Priority Data

Feb. 21, 1985 [JP] Japan ..... 60-33346
Feb. 21, 1985 [JP] Japan ..... 60-23674[U]

[51] Int. Cl.[4] ..... D05B 57/26
[52] U.S. Cl. ..... 112/231
[58] Field of Search ..... 112/181, 182, 184, 228, 112/229, 230, 231

[56] References Cited

U.S. PATENT DOCUMENTS

| | | | |
|---|---|---|---|
| 2,250,121 | 7/1941 | Zonis | 112/228 |
| 2,673,541 | 3/1954 | Biesemeyer | 112/181 |
| 2,974,618 | 3/1961 | Kuhar | 112/231 |
| 3,074,367 | 1/1963 | Habedank et al. | 112/228 |
| 3,146,744 | 9/1964 | Bradshaw | 112/232 |
| 3,343,510 | 9/1967 | Attwood et al. | 112/228 |
| 4,393,798 | 7/1983 | Cheng | 112/231 |
| 4,572,091 | 2/1986 | Gustmann et al. | 112/229 |

FOREIGN PATENT DOCUMENTS

| | | | |
|---|---|---|---|
| 1044572 | 11/1958 | Fed. Rep. of Germany | 112/231 |
| 679949 | 9/1952 | United Kingdom . | |
| 728247 | 4/1955 | United Kingdom | 112/231 |

*Primary Examiner*—Wm. Carter Reynolds
*Attorney, Agent, or Firm*—Wenderoth, Lind & Ponack

[57] ABSTRACT

A fully rotating hook includes an inner bobbin case, an outer loop taker mounted about the bobbin case, the loop taker having a track groove formed therein, a rotating member for rotating the loop taker such that relative rotation occurs between the loop taker and the bobbin case, and a stopper member for preventing rotation of the bobbin case with the loop taker while the loop taker is rotating. The bobbin case includes a case body having a bottom and accommodated in the loop taker, and a track projection member made of synthetic resin material having a substantially small friction coefficient and removably fixed to the case body. The track projection member includes a flange-like track projection fitting within the track groove of the loop taker and a surrounding portion for surrounding the bottom of the loop taker.

11 Claims, 9 Drawing Figures

ROTARY HOOK

BACKGROUND OF THE INVENTION

1. Field of the Invention

The present invention relates to a rotary hook, more particularly to a construction wherein an inner bobbin case is supported by a rotary outer loop taker with a flange-like track projection formed on the bobbin case being fitted into a track groove fromed in the loop taker.

2. Description of the Prior Art

In a rotary hook wherein an outer loop taker is driven for rotation with a flange-like track projection formed on an inner bobbin case fitting into a track groove formed in the loop taker and the bobbin case is stopped from rotating, the loop taker cannot be rotated at an exceedingly high speed due to friction between the track groove and the track projection. Hence there is a limit to making improvements in the sewing performance. Conventionally it has been proposed to supply lubricant oil between the track groove and the track projection so as to reduce frictional resistance produced therebetween. In such prior art arrangement, however, the thread tends to be soiled by the lubricant oil thus employed. The sewing operation cannot therefore be executed smoothly.

SUMMARY OF THE INVENTION

With a view to solving the aforementioned problems, it is an object of the invention to provide an improved and novel rotary hook.

It is another object of the invention to provide a rotary hook wherein an outer loop taker is rotated at an extremely high speed so as to effect sewing performance of high speed.

It is still another object of the invention to provide a fully rotary hook adapted such that the high speed rotation of the loop taker is enabled by minimizing the frictional resistance between the outer loop taker and the inner bobbin case so as to improve the sewing efficiency, and that soiling of the thread or the like due to lubricant oil is prevented to ensure the smooth sewing operation.

In accomplishing the above objects, a rotary hook according to an aspect of the invention comprises an inner bobbin case having a track projection formed thereon, an outer loop taker mounted about the bobbin case and having a track groove formed therein, means for rotating the loop taker such that relative rotation occurs between the loop taker and the bobbin case, with such rotation being guided by the projection fitting within the groove, stopper means for preventing rotation of said bobbin case with respect to the loop taker while said loop taker is rotating, the improvement wherein a coating layer made of synthetic resin material having a substantially small friction coefficient is applied to at least part of side walls or bottom of the track groove in the loop taker.

Hence, according to the present invention, the coating layer which is made of synthetic resin material having a small friction coefficient is applied in the track groove in the loop taker, thereby effecting a reduction in the frictional resistance between the track projection on the bobbin case and the track groove in the loop taker. Accordingly, improved sewing performance is provided.

A fully rotating hook according to another aspect of the invention comprises an inner bobbin case an outer loop taker mounted about the bobbin case and having a track groove formed therein, means for rotating the loop taker such that relative rotation occurs between the loop taker and the bobbin case, and stopper means for preventing rotation of the bobbin case with respect to the loop taker while the loop taker is rotating, the improvement wherein the bobbin case comprises a case body having a bottom and accommodated in the loop taker; and a track projection member made of synthetic resin material having a substantially small friction coefficient and removably fixed to the case body, the track projection member comprising a flange-like track projection fitting within the track groove of the loop taker and a surrounding portion for surrounding bottom of the casebody.

In a preferred embodiment, the flange-like track projection is formed with a loop spreading portion and a cut-out portion for cutting thread, and the track projection member is made integral such that the loop spreading portion of the flange-like track projection is connected with the surrounding portion.

In another preferred embodiment, the surrounding portion is provided with a thread cut-off portion having a high degree of smoothness.

Hence, according to the present invention, the track projection member comprising the flange-like track projection and the surrounding portion connected therewith is made of synthetic resin material having small frictional resistance, thus reducing the frictional resistance between the bobbin case and the loop taker. As a result, the loop taker is permitted to rotate smoothly at a high speed, which leads to improvement of the sewing performance. Furthermore according to the present invention, lubricant oil as used in the prior device is not employed, thereby preventing the thread or the like from being soiled by such lubricant oil. Consequently, a smooth sewing operation can be achieved.

Also, since the loop spreading portion of the track projection is adapted to integrally connect with the surrounding portion, the needle thread is prevented from being caught between the case body and the loop spreading portion. Moreover, the needle thread readily slides on the thread cast-off portion of the surrounding portion, thereby also assuring improvement on the sewing performance.

Furthermore, according to the present invention, the worn track projection member can be exchanged with a new one, thereby enabling the case body to economically last a long period of time.

BRIEF DESCRIPTION OF THE DRAWINGS

These and other objects, features and advantages of the invention will become more apparent from the following detailed description, taken with the accompanying drawings, in which.

DETAILED DESCRIPTION OF THE PREFERRED EMBODIMENTS

Figure 1:
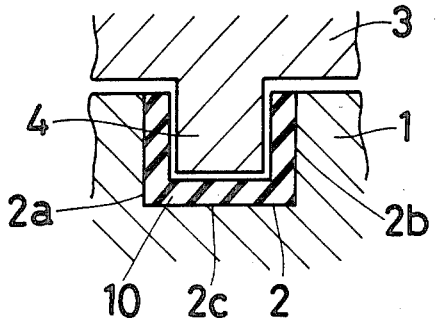
FIG. 1 is a sectional view partially showing an embodiment of the invention.

Referring now to the drawings, preferred embodiments of the invention are described below.

Figure 2:
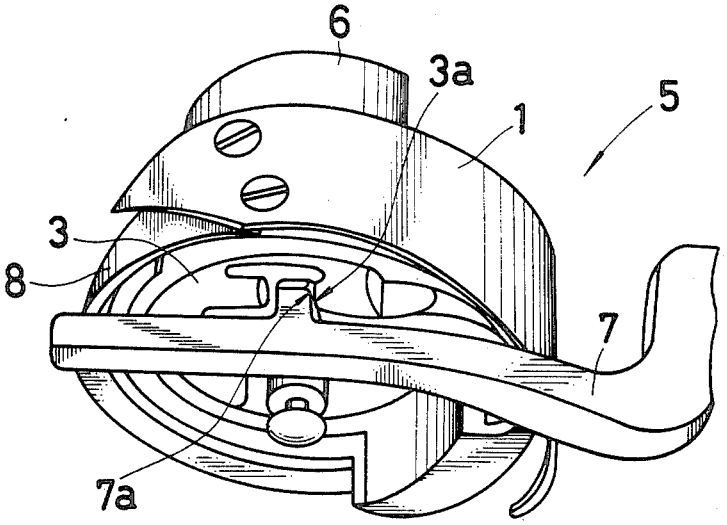
FIG. 2 is a perspective view showing a vertically fully rotating hook of this embodiment of the invention.

FIG. 1 is a sectional view showing a track groove 2 formed in an outer loop taker 1 and a flange-like track projection 4 formed on an inner bobbin case 3 and also the vicinity thereof. FIG. 2 is a perspective view showing a vertically oriented fully rotary hook 5 having such construction. The outer loop taker 1 is driven for rotation at a high speed by a drive shaft 6. The inner bobbin case 3 is stopped from rotating by an inner bobbin case retaining member 7. A cone point 8 is formed on the loop taker 1. A bobbin (not shown) for winding a bobbin thread therearound is accommodated in the bobbin case 3. The track projection 4 fitted into the track groove 2 as shown in FIG. 1 permits the bobbin case 3 to be held soundly.

According to the present invention, a coating layer 10 of substantial U shape in section is applied in the track groove 2 in the loop taker 1 along its bottom 2*c* and side walls 2*a* and 2*b*. The coating layer 10 is made of synthetic resin material having a small friction coefficient, for example Teflon (trade name). The other portions of the outer loop taker 1 are made of steel. The inner bobbin case 3 including the track projection 4 is likewise made of steel. The coating layer 10 may be adapted to be bonded to the track groove 2 by means of an adhesive agent, or may be applied in the track groove 2 by other methods. The use of Teflon with a small friction coefficient effects reduction in the pressure of contact between a retained portion 3*a* of the bobbin case 3 and a retaining portion 7*a* of the retaining member 7 which is caused when the loop taker 1 is rotating. In consequence, the sewing performance is improved. The occurrence of what is called "looping" is also improved. Furthermore, the use of lubricant oil is avoided.

Figure 3:
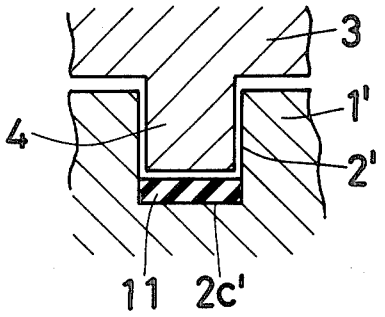
FIG. 3 is a sectional view partially showing still another embodiment of the invention.

FIG. 3 is a sectional view of another embodiment of the invention. In the embodiment shown, a coating layer 11 is applied to the bottom 2*c*′ of the track groove 2′ in the loop taker 1′. Such arrangement is capable of accomplishing a reduction in the friction produced between the track projection 4 on the bobbin case 3 and the track groove 2′ in the loop taker 1′, thereby permitting the loop taker 1′ to rotate at a high speed.

Figure 4:
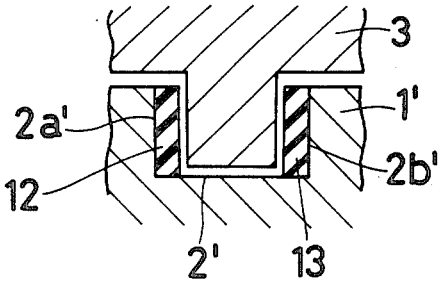
FIG. 4 is a sectional view showing partially yet another embodiment of the invention.

In still another embodiment as shown in FIG. 4, only on the side walls 2*a*′ and 2*b*′ of the track groove 2′ in the loop taker 1′ have applied thereto coating layers 12 and 13 with a small friction coefficient and made of synthetic resin material. Such embodiment is also within the scope and the spirit of the invention.

In yet another embodiment, as material for the coating layers 10, 11, 12 and 13, there may be employed porous spongy synthetic resin material in small holes of which lubricant oil is applied.

Figure 5:
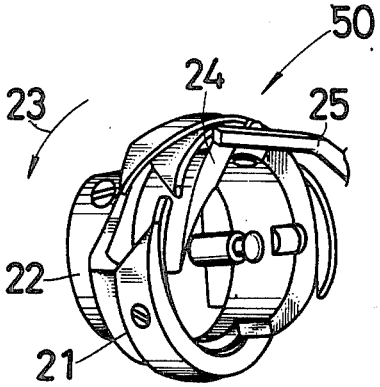
FIG. 5 is a perspective view showing a vertically fully rotating hook of a further embodiment of the invention.

FIG. 5 is a perspective view showing a further embodiment of the invention. An outer loop taker 21 is driven to rotate in the direction shown by arrow 23 by a drive shaft connected to a linking portion 22. An inner bobbin case 24 is mounted in the outer loop taker 21. The inner bobbin case 24 is stopped from rotating by an inner bobbin case retaining member 25. A vertically fully rotating hook 50 is thus formed.

Figure 6:
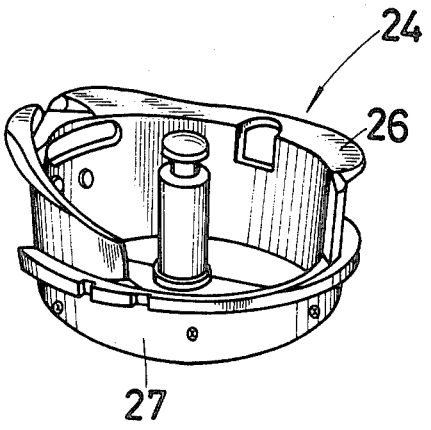
FIG. 6 is a perspective view of the inner bobbin case of FIG. 5.
Figure 7:
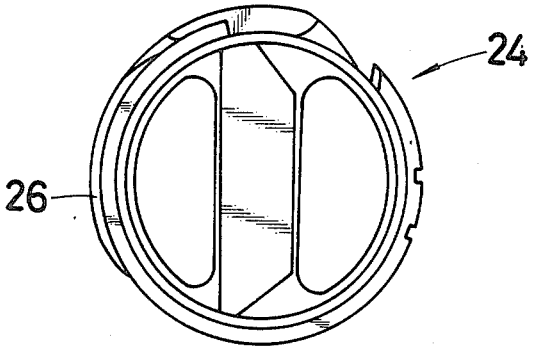
FIG. 7 is a bottom view of the inner bobbin case therefore.

FIG. 6 is a perspective view of the inner bobbin case 24. FIG. 7 is a bottom view of the inner bobbin case 24. The inner bobbin case 24 comprises a case body 26 having a bottom 28 (FIG. 8) and a track projection member 27 releasably mounted on the case body 26.

Figure 8:
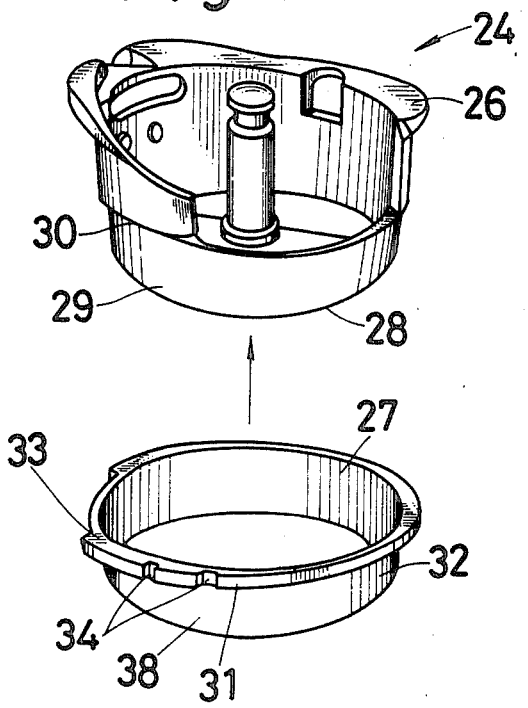
FIG. 8 is an exploded perspective view showing the inner bobbin case thereof.

FIG. 8 is an exploded perspective view of the inner bobbin case 24. The case body 26 of the bobbin case 24 extends in an axial direction and is made of iron, aluminum, or the like. A fitting portion 29 of smaller diameter is defined for the area extending from the halfway point in the axial direction of the case body 26 to the bottom 28. The fitting portion 29 is provided with a stepped portion 30 as shown in FIG. 9 to be discussed below on the opened edge side thereof (the upward side as viewed in FIG. 8).

Figure 9:
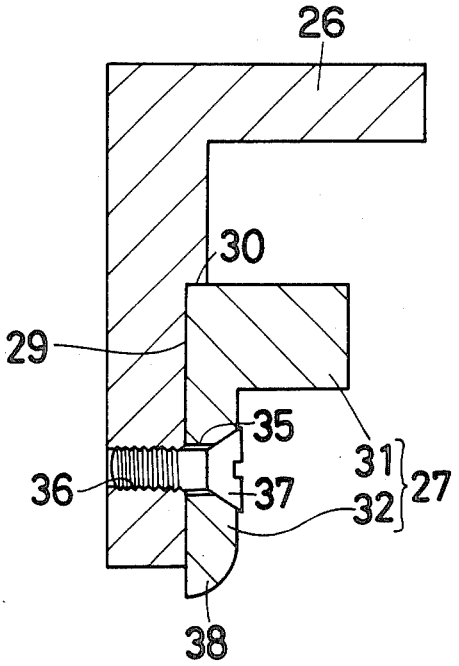
FIG. 9 is a sectional view showing partially the case body and the track projection member of FIG. 5.

FIG. 9 is a sectional view showing the fitting portion 29 and its vicinity. The track projection member 27 is made of synthetic resin material having low frictional resistance, for example Teflon (trade name). The track projection member 27 is basically composed of an externally directed flange-like track projection 31 to fit into a track groove of circular shape formed in the inner peripheral surface of the outer loop taker 21 and a surrounding portion 32 extending in the axial direction, for surrounding the fitting portion 29 and bottom 28 of the bobbin case 24, connected with the track projection 31. The track projection 31 is formed with a loop spreading portion 33 and spaced circumferentially therefrom are thread cutting cut-out portions 34 which are effective to sever thread if not spread correctly by the spreading portion 33, with the thread slipping between the rib 231 and the looptaker groove. The surrounding portion 32 is formed with fixing holes 35 circumferentially spaced at regular intervals, for example 120° from one another. The fitting portion 29 is formed with an internal thread 36 corresponding to the fixing hole 35. A screw 37 inserted into the fixing hole 35 is screwed on the inner thread 36. Such arrangement enables the track projection member 27 to be removably mounted on the case body 26.

In the above arrangement, the loop spreding portion 33 is adapted to communicate with the surrounding portion 32 so as to be integral therewith. Accordingly, there is avoided the problem of a needle thread being caught between the loop spreading portion 33 and the case body 26. If, however, an arrangement were made in which the track projection 31 without such surrounding portion 32 simply is fixedly fitted into the case body 26, the thread would become located between the loop spreading portion 33 and the case body 26, thereby deteriorating the sewing performance. Such problem can be solved by the present invention.

A thread cast-off portion 38 is formed by rounding the axial end surface of the surrounding portion is excellent in smoothness of thread handling, thus effecting an improvement of the sewing performance. Besides, the track projection member 27 may be secured to the case body 26 with a bonding agent. The present invention may be applied in the horizontally oriented fully rotating hook assembly as well as the vertically oriented fully rotating hook assembly.

In a further embodiment, only the flange-like track projection 31 may be made of synthetic resin material having low frictional resistance, and the case body 26 may be made of metal and formed with the surrounding portion 32.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and the range of equivalency of the claims are therefore intended to be embraced therein.

We claim:

1. In a fully rotating hook being of the type comprising an inner bobbin case extending in an axial direction, an outer loop taker mounted about said bobbin case, said loop taker having a track groove formed therein, means for rotating said loop taker such that relative rotation occurs between said loop taker and said bobbin case, and stopper means for preventing rotation of said bobbin case with said loop taker while said loop taker is rotating, the improvement wherein said bobbin case comprises:

a case body having a fitting portion extending in said axial direction and accommodated in said loop taker; and a track projection member made of synthetic resin material having a substantially low coefficient of friction and removably fixed to said fitting portion of said case body, said track projection member comprising a flange-like track projection fitting within said track groove of said loop taker and a surrounding portion extending in said axial direction for fixing said track projection member to said fitting portion of said case body, said fitting portion of said case body being smaller than the remainder of said case body to form a stepped portion therebetween and said track projection member being fitted to said case body with said track projection fitted against said stepped portion.

2. The improvement claimed in claim 1, wherein said flange-like track projection is formed with a loop spreading portion and at least one cut-out portion for cutting thread, said at least one cut-out portion being spaced circumferentially from said loop spreading portion, said track projection being formed integrally with said surrounding portion.

3. The improvement claimed in claim 1, wherein said surrounding portion is joined at one axial end thereof to said track projection and the other axial end of said surrounding portion is rounded to form a thread cast-off portion which provides smoothness in thread handling.

4. The improvement of claim 1, wherein said case body is of iron.

5. The improvement of claim 1, wherein said case body is of aluminum.

6. In a fully rotating hook being of the type comprising an inner bobbin case extending in an axial direction, an outer loop taker mounted about said bobbin case, said loop taker having a track groove formed therein, means for rotating said loop taker such that relative rotation occurs between said loop taker and said bobbin case, and stopper means for preventing rotation of said bobbin case with said loop while said loop taker is rotating, the improvement wherein said bobbin case comprises:

a case body having a fitting portion extending in said axial direction and accommodated in said loop taker; and a track projection member made of synthetic resin material having a substantially low coefficient of friction and removably fixed to said fitting portion of said case body, said track projection member comprising a flange-like track projection fitting within said track groove of said loop taker and a surrounding portion extending in said axial direction for fixing said track projection member to said fitting portion of said case body, said track projection member being removably fixed to said case body with a plurality of screws extending radially between said surrounding portion of said track projection member and said fitting portion of said case body.

7. The improvement claimed in claim 6, wherein said flange-like track projection is formed with a loop spreading portion and at least one cut-out portion for cutting thread, said at least one cut-out portion being spaced circumferentially from said loop spreading portion, said track projection being formed integrally with said surrounding portion.

8. The improvement claimed in claim 6, wherein said surrounding portion is joined at one axial end thereof to said track projection and the other axial end of said surrounding portion is rounded to form a thread cast-off portion which provides smoothness in thread handling.

9. The improvement of claim 1, wherein the diameter of said fitting portion of said case body is smaller than the remainder of said case body to form a stepped portion therebetween and said track projection member is fitted to said case body with said track projection fitted against said stepped portion.

10. The improvement of claim 1, wherein said case body is of iron.

11. The improvement of claim 1, wherein said case body is of aluminum.

* * * * *